United States Patent [19]

Cohen

[11] 4,187,627

[45] Feb. 12, 1980

[54] PADS FOR BUCKS OF GARMENT PRESSING MACHINES

[75] Inventor: Jerome H. Cohen, Bayside, N.Y.

[73] Assignee: Burtest Products Corp., New York, N.Y.

[21] Appl. No.: 924,191

[22] Filed: Jul. 13, 1978

[51] Int. Cl.[2] ..... D06F 81/14; D06F 83/00

[52] U.S. Cl. ..... 38/66; 38/140

[58] Field of Search ..... 38/27, 66, 140; 428/102

[56] References Cited

U.S. PATENT DOCUMENTS

| | | | |
|---|---|---|---|
| 1,666,870 | 4/1928 | Beck | 38/66 |
| 2,482,412 | 9/1949 | Gershon | 38/140 X |
| 2,835,056 | 5/1958 | Landers et al. | 38/66 |
| 3,323,238 | 6/1967 | Cohen | 38/66 |
| 3,471,955 | 10/1969 | Cohen | 38/66 |
| 3,634,957 | 1/1972 | Zeidler | 38/66 |
| 3,733,724 | 5/1973 | Davis | 38/66 X |
| 4,043,062 | 8/1977 | Lehrman | 38/66 X |

*Primary Examiner*—Louis Rimrodt

*Attorney, Agent, or Firm*—Kirschstein, Kirschstein, Ottinger & Cobrin

[57] ABSTRACT

This buck press pad overlies a perforated metal plate or grid fitted over the buck of a garment steam and vacuum supplied garment pressing machine. The pad is multi-layered to diffuse the steam coming up through the apertures in the metal grid and through which vacuum sucks air down to press the garment. Said pad comprises one or more pairs of layers, each pair comprising a lower preferably loosely woven fiber-layer and an upper preferably closely woven fiber layer. At the top of these layers is a thicker layer of rubber of felt or other resilient material covered at its upper side by a woven top cover layer on which the garment to be pressed, is placed. The top cover layer is preferably closely woven. At least the pairs of layers of the pad, is bound by a binder of high temperature material which is preferably coated with high temperature material such as Teflon or silicone, the stitching for the binder and pairs of layers, being preferably accomplished with high temperature thread. The binding is stitched to a skirt surrounding the outer edge of the pad and buck and carries some means for tightening the pad to the buck.

6 Claims, 7 Drawing Figures

PADS FOR BUCKS OF GARMENT PRESSING MACHINES

This invention relates to pads for covering bucks of garment pressing machines supplied with steam and vacuum producing systems.

An object of this invention is to improve on pressing machine pads such as disclosed in U.S. Pat. No. 3,323,238.

Another object of this invention is to provide a pad of the character described provided with a plurality of pairs of loosely woven and tightly woven layers, thereby increasing the pad thickness and increased means to diffuse the steam passing through the buck and to increase the effective vacuum, to provide for better pressing of the garment.

Still another object of this invention is to provide a highly improved buck pad of the character described, wherein in each pair of layers, the lower layer is loosely woven and the upper layer is closely woven. The lower layer may comprise loosely woven glass cloth preferably impregnated with Teflon or other high temperature material, but could be unimpregnated or not treated with high temperature material. The upper layer may comprise Nomex, nylon, polyester, glass or other high temperature woven or knitted cloth or any sheeting of felted high temperature resisting material through which steam may pass or be drawn through. The upper layer is preferably coated with high temperature resistant material such as Teflon.

Still another object of this invention is to provide a pad of the character described, in which at least the pairs of layers are bound at its edges with binder and provided with a skirt of high temperature resisting material preferably treated with a Teflon coating or other high temperature resistant material, and in which the skirt is stitched to the binder.

Yet another object of this invention is to provide in a pad of the character described a sub-pad comprising said pairs of lower loosely woven and upper closely woven layers, a binder for the edges of said sub-pad, a skirt stitched to said binder and sub-pad, a layer of rubber like material disposed over the subpad, and a top cover of closely woven material overlying the rubber like layer and provided with a skirt having means for attaching the cover to the sub-pad.

A further object of this invention is to provide a pad of the character described which shall be durable and which shall be relatively inexpensive to manufacture, and which shall produce good pressing for garments and which shall be highly efficient for the purpose intended.

Other objects of this invention will in part be obvious and in part hereinafter pointed out.

The invention accordingly consists in the features of construction, combinations of elements, and arrangement of parts which will be exemplified in the construction hereinafter described and of which the scope of invention will be indicated in the following claims.

IN THE DRAWINGS

Figure 1:
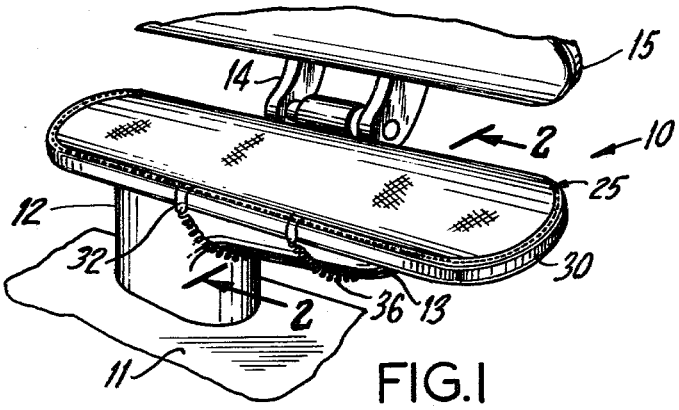
FIG. 1 is a perspective view of a pressing machine provided with a press pad for the buck of the machine, which embodies the invention.

Referring now in detail to the drawing, 10 designates a garment pressing machine comprising a base 11 from which a vertical support 12 projects upwardly and supports a buck 13. Hinged to the buck 13 as at 14 is a head 15. This garment pressing machine has usual steam supply system to pass steam into the interior 19 of the buck chamber. At the top of the buck is a usual metal grid or plate 16 formed with small holes or perforations 17 and fixed to the buck in the usual manner. The grid is convex and is fixed to the outer upper edge 18 of the buck and forms a chamber 19. In ordinary use, steam is passed to the chamber 19 and can pass through the perforations 17. Also a vacuum system is furnished. After the steam is turned off, vacuum is applied to the chamber 19 to draw the moist steam pressed garment to a pad 25 on the grid, (to be described hereinafter), to dry the garment and produce a well pressed garment.

The pad 25, embodying the invention, is mounted on top of the grid 16 and comprises one or more pairs of bottom and top layers 26, 27, respectively. Although the drawing shows three such superposed pairs of layers, the number can be varied, that is increased or decreased.

The lower layers 26 of each pair are loosely woven glass cloth, or other high temperature material such as Nomex, and may be coated with high temperature resistant resins like Teflon, silicone, Viton.

The upper layers 27 are of closely woven or knitted high temperature resistant materials such as Nomex, glass or any sheeting or felted high temperature resistant material. The layers 27 are also preferably coated or treated with high temperature material such as Teflon, if desired.

On top of the topmost layer 27 is a thick layer 28 of resilient material such as rubber or felt. On top of the thick layer 28 is a top cover sheet 29 of preferably closely woven fibers of high heat resistant material such as Teflon or Nomex or of nylon, polyester or cotton which preferably is coated or treated with high heat resistant material.

A binder 30 overlies the edges of the layers 26, 27, 28, 29, 30, and is stitched thereto as at 31. The binding 30 covers the edges of the layers. Preferably the binder is of high heat resistant material and is preferably coated with high heat resistant material. Also high temperature resistant thread is used for the stitching.

Stitched to the top of the binding by said line of stitching 31 is a skirt 32 which extends all around the pad and projects down below the pad to overlap the buck 13. Skirt 32 is provided at its lower end with eyelet openings 34 to receive hooks 35 at ends of coil tension springs 36 for clamping the pad to the buck.

The high heat resistant material should resist temperatures of 500° Fahrenheit.

Figure 5:
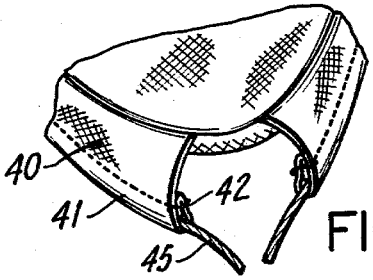
FIG. 5 is a partial perspective view of a pad with binding and draw-string exemplifying a modified construction.

In FIG. 5, the pad has a skirt 40 provided with a rolled up portion 41 stitched back as at 42 to provide a passage for a draw string 45. The skirt is open at one end as shown in FIG. 5, to allow the draw string ends to be pulled tight to firmly attach the pad to the buck, thereby obviating necessity for the springs 36.

The rubber layer 28 could be smaller than the layers 26, 27 so that stitching 31 will not go through the rubber layer, or it could be of same size as layers 26, 27 with the stitching going therethrough.

Figure 2:
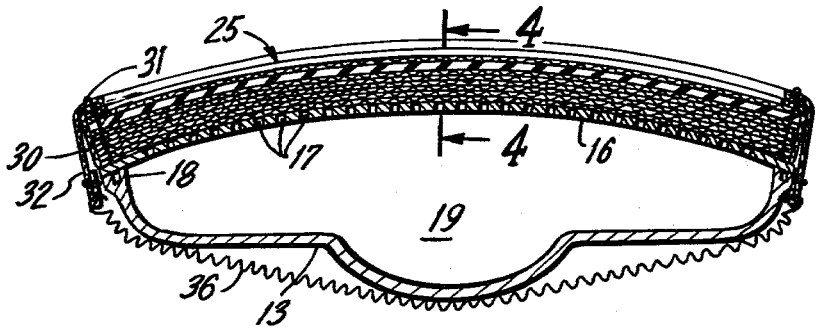
FIG. 2 is an enlarged cross-sectional view taken on line 2—2 of FIG. 1.
Figure 3:
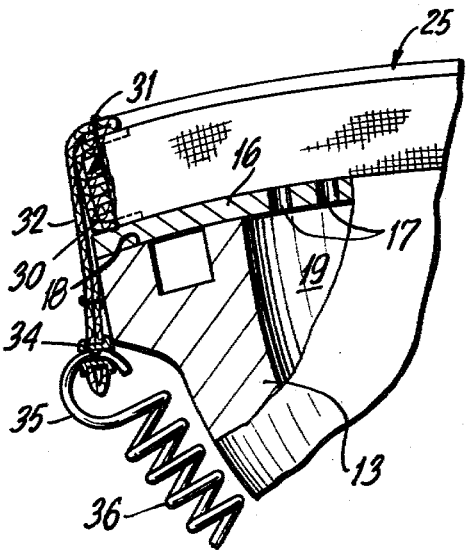
FIG. 3 is a partial, enlarged, cross-sectional view of a buck provided with a pad embodying the invention.
Figure 4:
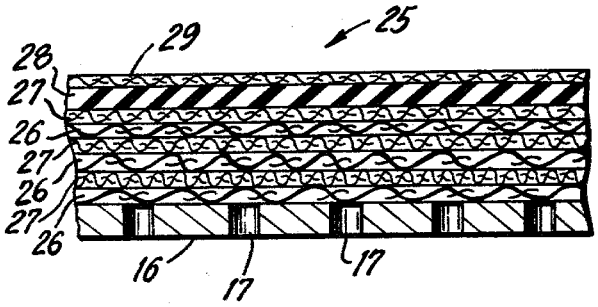
FIG. 4 is an enlarged cross-sectional view taken on line 4—4 of FIG. 2.
Figure 6:
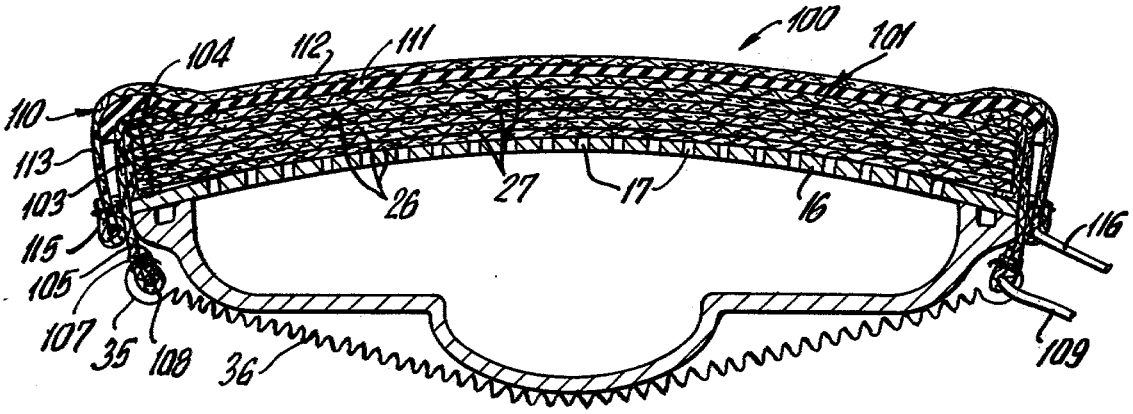
FIG. 6 is a transverse cross-sectional view of a modified form of the invention.
Figure 7:
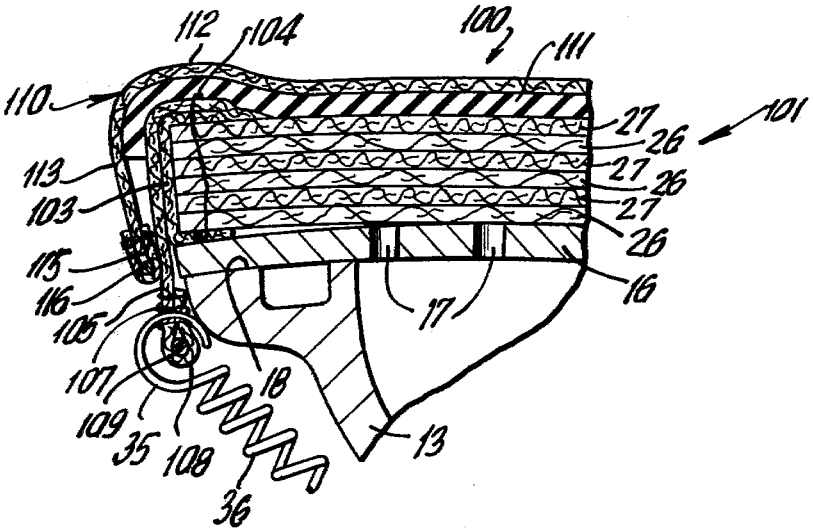
FIG. 7 is an enlarged edge portion of the structure shown in FIG. 6.

In FIGS. 6 and 7 there is illustrated another modified form of the invention. The pad 100 of FIGS. 6 and 7 comprises a subpad 101 comprising pairs of layers, with a lower layer 26 and an upper layer 27 in each pair. They are similar to layers 26, 27 of FIGS. 2, 3 and 4. These layers 26, 27 are bound together by a binder 103 stitched by a line of stitching 104. A skirt 105 is stitched to the upper end of the binding 103 by said line of stitching 104 and extends down below the lower end of the sub-pad. The lower end of the skirt 105 may be provided with grommets 107 to receive hooked ends 35 of coil tension springs 36 to clamp the sub-pad 101 to the buck.

If desired, said skirt 105 could have a stitched back sleeve 108 to receive a draw string 109 for clamping the sub-pad 101 to the buck, thereby eliminating necessity for the springs 36.

Placed over the sub-pad 101 is a cover pad 110 comprising a thicker rubber like layer or felt soft layer 111, the outer edge portions of which bend down and around the upper end of skirt 105, as shown in FIG. 7. Overlying the layer 111 is a top cover element 112 of closely woven material similar to the material of layer 29 of FIG. 4. Top cover 112 has a skirted border 113 extending downwardly and terminating at its lower edge in a sleeve 115 disposed above the lower edge of skirt 105, to receive a draw string 116 to clamp the cover pad 110 to the sub-pad 101.

The advantage of pad 100 over pad 25 is that the layers 28, 29 of pad 25 or layers 111, 112 of pad 100 sometimes wear out before layers 26, 27. With the construction of pad 100, worn out layers 111, 112 of assembly 110 can be removed and replaced while the layers 28, 29 of pad 25 could not be readily replaced without tearing the pad.

It will be understood that to replace elements 111, 112 from pad 100, it is only necessary to untie pull string 116 so that a new top cover assembly 110 can be substituted.

It will thus be seen that there is provided a device in which the several objects of this invention are achieved and which is well adapted to meet the conditions of practical use.

As various possible embodiments might be made of the above invention, and as various changes might be made in the embodiment above set forth, it is to be understood that all matter herein set forth or shown in the accompanying drawings is to be interpreted as illustrative.

I claim:

1. A buck pad to be placed on a perforated plate of a buck of a garment pressing machine, said pad comprising a sub-pad, said sub-pad comprising one or more pairs of layers, each pair comprising upper and lower superposed layers of textile material, said lower layers having relatively loosely integrated threads and said upper layers having relatively closely integrated threads, all said layers comprising high temperature resisting material, a binding stitched to the edges of said layers and a skirt stitched to said binding and extending down therefrom, said binding and skirt being made of high temperature resisting material, a cover pad on the sub-pad, said cover pad comprising a layer of soft resilient material, thicker than each layer of said pair or pairs of layers, placed over the top most layer of said sub-pad, and a top cover of relatively closely integrated threads, over said soft resilient layer and having a skirt extending downwardly and provided with means to attach said cover pad to said sub-pad, said top cover being made of high heat resisting material.

2. The combination of claim 1, said lower layers of said pairs of layers being coated with high heat resistant material.

3. The combination of claim 2, said upper layers of said pairs of layers being coated with high heat resistant material.

4. The combination of claim 1, said binding being coated with high heat resistant material.

5. The combination of claim 4, said skirt being coated with high heat resistant material.

6. The combination of claim 5, said top cover of said cover pad being coated with high heat resistant material.

* * * * *